US010847069B2

(12) United States Patent
Wang et al.

(10) Patent No.: US 10,847,069 B2
(45) Date of Patent: Nov. 24, 2020

(54) DISPLAY LIGHT-ON TEST DEVICE AND METHOD

(71) Applicant: WUHAN CHINA STAR OPTOELECTRONICS SEMICONDUCTOR DISPLAY TECHNOLOGY CO., LTD., Hubei (CN)

(72) Inventors: Hai Wang, Hubei (CN); Kunyueh Tsai, Hubei (CN)

(73) Assignee: Wuhan China Star Optoelectronics Technology Co., Ltd., Hubei (CN)

( * ) Notice: Subject to any disclaimer, the term of this patent is extended or adjusted under 35 U.S.C. 154(b) by 85 days.

(21) Appl. No.: 16/099,863

(22) PCT Filed: Aug. 29, 2018

(86) PCT No.: PCT/CN2018/102916
§ 371 (c)(1),
(2) Date: Nov. 8, 2018

(87) PCT Pub. No.: WO2019/227731
PCT Pub. Date: Dec. 5, 2019

(65) Prior Publication Data

US 2020/0074898 A1 Mar. 5, 2020

(30) Foreign Application Priority Data

Jun. 1, 2018 (CN) ..... 2018 1 0557646

(51) Int. Cl.
*G09G 3/00* (2006.01)

(52) U.S. Cl.
CPC ..... *G09G 3/006* (2013.01)

(58) Field of Classification Search
CPC ..... G09G 3/006; G09G 3/20; G09G 2360/06; G09G 2330/04; H01L 27/124
(Continued)

(56) References Cited

U.S. PATENT DOCUMENTS

2018/0068601 A1* 3/2018 Han ..... G01R 1/067
2018/0188289 A1* 7/2018 Qu ..... G01R 1/06794

FOREIGN PATENT DOCUMENTS

CN 104360509 A 2/2015
CN 105304000 A 2/2016
(Continued)

*Primary Examiner* — Vincent Q Nguyen
*Assistant Examiner* — Trung Nguyen
(74) *Attorney, Agent, or Firm* — Muncy, Geissler, Olds & Lowe, P.C.

(57) ABSTRACT

In an embodiment, the display light-on test device includes: a plurality of D-type connectors configured to be correspondingly connected to mobile phones with different connector types, and receive and transmit power signals; a sampling processor configured to receive the power signals, sample and quantize the power signals into digital data and/or image data, and output the data to a field programmable gate array chip, receive commands, and output, according to the commands, corresponding micro control commands; the field programmable gate array chip connected to the D-type connectors and the sampling processor, and configured to receive the data and the micro control commands, generate corresponding micro control parameters, and process, according to the micro control parameters, the data, to output data required to perform the light-on tests to the display modules to be tested, so that the light-on tests are performed on the display modules to be tested.

20 Claims, 5 Drawing Sheets

(58) Field of Classification Search
USPC ..... 324/500, 522, 539, 543, 664, 694, 658, 324/548, 678, 686, 760.01, 765, 768, 600, 324/76.11, 754.26, 713, 84, 403, 412, 324/200, 222
See application file for complete search history.

(56) References Cited

FOREIGN PATENT DOCUMENTS

| | | | |
|---|---|---|---|
| CN | 205405001 | U | 7/2016 |
| CN | 106771974 | A | 5/2017 |
| CN | 107564447 | A | 1/2018 |
| KR | 20070074179 | A | 7/2007 |
| KR | 100844337 | B1 | 7/2008 |

* cited by examiner

DISPLAY LIGHT-ON TEST DEVICE AND METHOD

FIELD OF INVENTION

The present disclosure relates to a technical field of displays, and more particularly to a display light-on test device and a display light-on test method.

BACKGROUND OF INVENTION

Since the release of IPhone X, full screen displays of OLED display technologies have been widely accepted by consumers, and the market reaction has been dramatic. In the foreseeable future, flexible displays applied with PI substrates must be extremely competitive display technologies. Regardless of whether they are full screen displays or flexible displays, their common technology bases are to combine and dispose DICs, TICs, Force Touchs, S-Pens, etc., on flexible circuit boards, and then wrap around panels until to backs of the panels. Then, flexible circuit boards are connected to mainboards of application processors of electronic devices such as mobile phones and pads through connectors having a plurality of pins. In addition to these different kinds of ICs, under different requirements of different manufacturers, even same kinds of ICs need to have configured connectors differ greatly in specifications such as length, width, number of pins, spacing of pins, etc. In this manner, when optical, electrical, power consumption, timing, issue analysis operations, etc., are performed on panels, a corresponding connector is needed for each of connectors of different types, and even a corresponding connecting test jig is needed for matching. This not only results in waste of material costs, but also need replacement corresponding to test requirements, causing waste of labor and time.

In the related art, for testing power consumption, timing, and processor interface signals of, for example, a DIC, a TIC, and a display of a mobile phone, an application processor of a mainboard of the mobile phone usually needs to be designed separately from a panel. By making a special transfer jig (e.g. disposing an FPC flexible circuit board), and reserving probes in the middle, a test function is realized. However, because connector types of different kinds of mobile phones differ greatly, if a corresponding test jig is made for each type of connector, for manufacturers, costs are bond to increase significantly.

SUMMARY OF INVENTION

An object of the present disclosure is to provide a display light-on test device and a display light-on test method, to solve the problem that a corresponding light-on test jig is required for each different kind and each different type.

Another object of the present disclosure is to provide a display light-on test device and a display light-on test method that simplify a design of a hardware portion of the display light-on test device under the premise that the original display light-on test technique is not significantly changed to adapt specially to different kinds of connector types, and perform a light-on test with only an integrated connector replaced for a different type of mobile phone, to save costs.

Still another objective of the present disclosure is to provide a display light-on test device and a display light-on test method that realize more complicated functions, such as automatically testing voltage, current, power consumption, and a processor interface decoding process, etc., using a field programmable gate array chip, and sending a resulting information of testing to a display for display.

In order to solve the aforementioned problem, the solution provided by the present disclosure is: providing a display light-on test device, wherein the device is configured to perform operation of light-on tests on a plurality of display modules to be tested simultaneously. The device includes: a plurality of D-type connectors configured to be correspondingly connected to matching display modules to be tested among mobile phones with different connector types, and receive and transmit processor interface power signal data, positive voltage power signal data, negative voltage power signal data, or TIC power signal data; a sampling processor configured to sample and quantize received DIC power signal data, TIC power signal data, positive voltage power signal data, or negative voltage power signal data into required digital signal data and/or image signal data, and output the digital signal data and/or image signal data to a field programmable gate array chip, and output, according to commands received by the sampling processor, corresponding micro control commands; the field programmable gate array chip connected to the D-type connectors and the sampling processor to receive the signal data and generate, according to the micro control commands, corresponding micro control parameters, and process the signal data according to the micro control parameters, to output signal data required to perform the light-on tests to the display modules to be tested, so that the light-on tests are performed on the display modules to be tested.

The display light-on test device further includes: an integrated connector, wherein the integrated connector is configured with a row of test lead plugs (male) and a row of test lead sockets (female) correspondingly on a left side and a right side of the integrated connector, and each test lead plug and each test lead socket are both connected to a matching voltage switch, current switch, and standard current switch. That is, each test lead plug on the left side is installed with the corresponding voltage switch, current switch, and standard current switch. Each test lead socket on the right side is installed with a corresponding inline voltage meter, inline current meter, and current regulator. Therefore, a display panel on the left side is connected to an application processor of a mobile phone on the right side, to form a display module to be tested.

Through the D-type connectors correspondingly connected to the matching display modules to be tested among the mobile phones with the different connector types, one-time inspections are performed, and the operation of the light-on tests is simultaneously performed.

With respect to a different type of mobile phone, only the integrated connector needs to be replaced for the display light-on test device to be adapted to the different type of mobile phone, and then a light-on test may be performed.

The field programmable gate array chip has a microprocessor, a display controller, and a storage controller storing computing programs integrated therein. The microprocessor is configured to output initialization information, and is connected to the display controller. The storage controller is connected to a D-type connector and the sampling processor, and configured to receive and store the digital signal data and/or image signal data and the micro control commands, and read the digital signal data and/or image signal data stored internally, and suitably provide read digital signal data and/or image signal data to the microprocessor. The field programmable gate array chip is connected to the D-type connector, which is connected to the display module to be tested, through the display controller, to output the initialization information to the display module to be tested for an initialization operation to be performed on the display module to be tested, and output processed digital data and/or image data required to perform a light-on test on the display module to be tested to the display module to be tested, so that the light-on test is performed on the display module to be tested.

Based on an aforementioned structure of the embodiment, the display light-on test device of the present disclosure performs one-time inspections on the display modules to be tested, and performs operation of the light-on tests simultaneously on the display modules to be tested through the following. The D-type connectors are correspondingly connected to the matching display modules to be tested among the mobile phones with the different connector types. The field programmable gate array chip is connected to the D-type connectors, which are correspondingly connected to the display modules to be tested, through the display controller, to output initialization information to the display modules to be tested for initialization operations to be performed on the display modules to be tested, and output processed digital data and/or image data required to perform the light-on tests on the display modules to be tested to the display modules to be tested, so that one-time inspections are performed on the display modules to be tested, and the operation of the light-on tests is simultaneously performed on the display modules to be tested.

The field programmable gate array chip further includes: a parameter configurator configured to receive micro control commands output from the storage controller, generate, according to the micro control commands, the corresponding micro control parameters, automatically process, according to the micro control parameters, the required digital data and/or image data from sampling the signal data, to generate the initialization information, which is then provided to the microprocessor. By connecting the microprocessor to the display controller, and the display controller to the display module to be tested, the initialization information is output to the display module to be tested for the initialization operation to be performed on the display module to be tested, and a final result is fed back to a display for display.

The field programmable gate array chip further includes: a digital/image processor connected to the storage controller, to receive digital data and/or image data output by the storage controller, wherein the digital/image processor is further connected to the parameter configurator, to process, according to the micro control parameters, the digital data and/or image data; and a selection controller connected to the digital/image processor, and configured to select, according to a selected type mode, one of digital data and/or image data output by the digital/image processor, and output processed digital data and/or image data to serve as the digital data and/or image data required to perform the light-on test on the display module to be tested, wherein the selection controller is further connected to the display controller which is connected to the D-type connector, so that the processed digital data and/or image data selected by the digital/image processor is provided to a corresponding display module to be tested.

The selection controller is further connected to the microprocessor, to receive a type mode selecting command output by the microprocessor, and operate, according to a mobile phone type selecting command, under a corresponding selected matching type mode.

The display light-on test device further includes: a power micro control module connected between the field programmable gate array chip and each of the D-type connectors, to receive power control parameters output by the field programmable gate array chip, and output, through each of the D-type connectors, a corresponding power voltage to each of the display modules to be tested according to the power control parameters, to control the light-on tests to be performed on the display modules to be tested at different power.

The field programmable gate array chip further includes: a power microcontroller connected to the parameter configurator and the power micro control module, wherein the control parameters generated by the parameter configurator include the power control parameters. The power microcontroller receives the power control parameters, generates, according to the power control parameters, corresponding power control commands, and outputs the corresponding power control commands to the power micro control module, which controls the corresponding power voltage to be output.

The sampling processor further includes: a digital-to-analog converter configured to sample and quantize voltage and current signals, and power consumption received by the sampling processor into required digital signals, and output the digital signals to the field programmable gate array chip, so that the field programmable gate array chip performs the light-on tests, thereby realizing automatic test operation.

When an initial code of a DIC processor interface of a display panel is given through the storage controller integrated in the field programmable gate array chip, the display panel is lightened directly through the field programmable gate array chip, without providing power to the display panel by the application processor, but providing power to the display panel by the field programmable gate array chip; or when an initial code of a DIC processor interface of a display panel is not given, an image is first compressed into a standard VESC image receivable by a DIC, and then the display panel is lightened through the application processor, a switch of the processor interface is then turned off, and the compressed image is sent through the field programmable gate array chip, and a final result is fed back to a display for display. The field programmable gate array chip can further be combined with an optical algorithm, to analyze optical issues.

In order to solve the aforementioned problem, another solution provided by the present disclosure is: providing a display light-on test method that uses any of the above display light-on test devices. The method includes: connecting a display panel to an application processor of a mobile phone through an integrated connector, to form a display module to be tested, wherein the integrated connector is configured with a test lead plug (male) and a test lead socket (female) correspondingly on a left side and a right side of the integrated connector; and the test lead plug and the test lead socket are both connected to a matching voltage switch, current switch, and standard current switch; receiving and transmitting power signals through a plurality of D-type connectors correspondingly connected to display modules to be tested among mobile phones with different connector types; receiving the power signals, sampling and quantizing the power signals into required digital data and/or image data, and outputting the digital data and/or image data to a field programmable gate array chip through a sampling processor; outputting initialization information through a microprocessor integrated in the field programmable gate array chip; outputting initialization information through a microprocessor integrated in the field programmable gate array chip; outputting the initialization information through a display controller integrated in the field programmable gate array chip; transmitting the initialization information through the D-type connectors to the display modules to be tested; and performing initialization operations on the display modules to be tested; reading stored digital data and/or image data required to perform light-on tests through a storage controller integrated in the field programmable gate array chip; receiving micro control commands sent by the sampling processor, generating, according to the micro control commands, corresponding micro control parameters, and processing, according to the micro control parameters, required digital data and/or image data through the field programmable gate array chip; and outputting processed digital data and/or image data required to perform light-on tests on the display modules to be tested to the display modules to be tested through the display controller integrated in the field programmable gate array chip and connected to the D-type connectors, so that one-time inspections are performed on the display modules to be tested and operation of the light-on tests is simultaneously performed on the display modules to be tested.

In order to solve the aforementioned problem, another solution provided by the present disclosure is: providing a display light-on test device, wherein the device is configured to perform operation of light-on tests on a plurality of display modules to be tested simultaneously. The device includes:

a plurality of integrated connectors, wherein each of the integrated connectors is configured with a corresponding test lead plug and a corresponding test lead socket on both sides of each of the integrated connectors; and the corresponding test lead plug and the corresponding test lead socket are both connected to a matching voltage switch, current switch, and standard current switch, so that the integrated connectors connect display panels of a corresponding plurality of mobile phones with different connector types to application processors thereof, to form the display modules to be tested;

a plurality of D-type connectors correspondingly connected to the display modules to be tested, and configured to receive and transmit power signals;

a sampling processor configured to receive the power signals, sample and quantize the power signals into required digital data and/or image data, and output the digital data and/or image data to a field programmable gate array chip, receive commands, and output, according to the commands, corresponding micro control commands; and the field programmable gate array chip having a microprocessor, a display controller, and a storage controller integrated therein, wherein the microprocessor is configured to output initialization information, and is connected to the display controller; the field programmable gate array chip outputs, through the display controller, the initialization information which is transmitted to the display modules to be tested through the D-type connectors, for initialization operations to be performed; the storage controller is connected to the D-type connectors and the sampling processor, and configured to receive the digital data and/or image data and the micro control commands; the field programmable gate array chip generates, according to the micro control commands, corresponding micro control parameters, and processes, according to the micro control parameters, the digital data and/or image data, to output digital data and/or image data required to perform the light-on tests on the display modules to be tested to the display modules to be tested, so that operation of the light-on tests is performed on the display modules to be tested simultaneously.

In accordance with an embodiment of the present disclosure, a digital-to-analog converter configured to sample and quantize voltage and current signals, and power consumption received by the sampling processor into required digital signals, and output the digital signals to the field programmable gate array chip, so that the field programmable gate array chip performs the light-on tests.

In accordance with an embodiment of the present disclosure, the sampling processor is further connected to a mobile phone/user command receiving module configured to receive mobile phone/user commands input by mobile phones/users, and output the mobile phone/user commands to the sampling processor.

In accordance with an embodiment of the present disclosure, the field programmable gate array chip further includes:

a parameter configurator connected to the storage controller, and configured to generate, according to the micro control commands, the corresponding micro control parameters;

a digital/image processor connected to the storage controller and the parameter configurator, and configured to receive digital data and/or image data output by the storage controller, and receive micro control parameters sent by the parameter configurator, and process, according to the micro control parameters, the digital data and/or image data; and a selection controller connected to the digital/image processor, and configured to operate under corresponding modes according to type mode selecting commands, perform selection processing on processed digital data and/or image data output by the digital/image processor, and output processed digital data and/or image data required to perform light-on tests on the display modules to be tested; and the selection controller is further connected to the display controller, so that selection processed digital data and/or image data is output through the display controller and transmitted through the D-type connectors to the corresponding display modules to be tested.

In accordance with an embodiment of the present disclosure, the selection controller is further connected to the microprocessor, and is further configured to receive type mode selecting commands output by the microprocessor, to operate, according to the type mode selecting commands, under corresponding modes.

In accordance with an embodiment of the present disclosure, the display light-on test device further includes: a power micro control module connected between the field programmable gate array chip and each of the D-type connectors, and configured to receive power control parameters output by the field programmable gate array chip, and output, through each of the D-type connectors, a corresponding power voltage to each of the display modules to be tested according to the power control parameters, to control the light-on tests to be performed on the display modules to be tested at different power.

In accordance with an embodiment of the present disclosure, the field programmable gate array chip further includes: a power microcontroller connected to the parameter configurator and the power micro control module, wherein the control parameters generated by the parameter configurator include the power control parameters; the power microcontroller is configured to receive the power control parameters, generate, according to the power control parameters, corresponding power control commands, and output the corresponding power control commands to the power micro control module, which controls the corresponding power voltage to be output.

In order to solve the aforementioned problem, another solution provided by the present disclosure is: providing a display light-on test device, wherein the device is configured to perform operation of light-on tests on a plurality of display modules to be tested simultaneously. The device includes:

an integrated connector, wherein the integrated connector is configured with a test lead plug and a test lead socket on both sides of the integrated connector; and the test lead plug and the test lead socket are both connected to a matching voltage switch, current switch, and standard current switch, so that the integrated connector connects a display panel to an application processor, to form a display module to be tested;

a plurality of D-type connectors correspondingly connected to the display modules to be tested, and configured to receive and transmit power signals;

a sampling processor configured to receive the power signals, sample and quantize the power signals into required digital data and/or image data, and output the digital data and/or image data to a field programmable gate array chip, receive commands, and output, according to the commands, corresponding micro control commands; and the field programmable gate array chip having a microprocessor, a display controller, and a storage controller integrated therein, wherein the microprocessor is configured to output initialization information, and is connected to the display controller; the field programmable gate array chip outputs, through the display controller, the initialization information which is transmitted to the display modules to be tested through the D-type connectors, for initialization operations to be performed; the storage controller is connected to the D-type connectors and the sampling processor, and configured to receive the digital data and/or image data and the micro control commands; the field programmable gate array chip generates, according to the micro control commands, corresponding micro control parameters, and processes, according to the micro control parameters, the digital data and/or image data, to output digital data and/or image data required to perform the light-on tests on the display modules to be tested to the display modules to be tested, so that operation of the light-on tests is performed on the display modules to be tested simultaneously.

In accordance with an embodiment of the present disclosure, a digital-to-analog converter configured to sample and quantize voltage and current signals, and power consumption received by the sampling processor into required digital signals, and output the digital signals to the field programmable gate array chip, so that the field programmable gate array chip performs the light-on tests.

In accordance with an embodiment of the present disclosure, the sampling processor is further connected to a mobile phone/user command receiving module configured to receive mobile phone/user commands input by mobile phones/users, and output the mobile phone/user commands to the sampling processor.

In accordance with an embodiment of the present disclosure, the field programmable gate array chip further includes:

a parameter configurator connected to the storage controller, and configured to generate, according to the micro control commands, the corresponding micro control parameters; and a digital/image processor connected to the storage controller and the parameter configurator, and configured to receive digital data and/or image data output by the storage controller, and receive micro control parameters sent by the parameter configurator, and process, according to the micro control parameters, the digital data and/or image data; and a selection controller connected to the digital/image processor, and configured to operate under corresponding modes according to type mode selecting commands, perform selection processing on processed digital data and/or image data output by the digital/image processor, and output processed digital data and/or image data required to perform the light-on tests on the display modules to be tested; and the selection controller is further connected to the display controller, so that selection processed digital data and/or image data is output through the display controller and transmitted through the D-type connectors to the corresponding display modules to be tested.

In accordance with an embodiment of the present disclosure, the selection controller is further connected to the microprocessor, and is further configured to receive type mode selecting commands output by the microprocessor, to operate, according to the type mode selecting commands, under corresponding modes.

In accordance with an embodiment of the present disclosure, the display light-on test device further includes: a power micro control module connected between the field programmable gate array chip and each of the D-type connectors, and configured to receive power control parameters output by the field programmable gate array chip, and output, through each of the D-type connectors, a corresponding power voltage to each of the display modules to be tested according to the power control parameters, to control the light-on tests to be performed on the display modules to be tested at different power.

In accordance with an embodiment of the present disclosure, the field programmable gate array chip further includes: a power microcontroller connected to the parameter configurator and the power micro control module, wherein the control parameters generated by the parameter configurator comprise the power control parameters; the power microcontroller is configured to receive the power control parameters, generate, according to the power control parameters, corresponding power control commands, and output the corresponding power control commands to the power micro control module, which controls the corresponding power voltage to be output.

In order to solve the aforementioned problem, another solution provided by the present disclosure is: providing a display light-on test method that uses any of the above display light-on test devices. The method includes:

connecting a display panel to an application processor through an integrated connector, to form a display module to be tested, wherein the integrated connector is configured with a test lead plug and a test lead socket on both sides of the integrated connector; and the test lead plug and the test lead socket are both connected to a matching voltage switch, current switch, and standard current switch;

receiving and transmitting power signals through a plurality of D-type connectors correspondingly connected to the display modules to be tested;

receiving the power signals, sampling and quantizing the power signals into required digital data and/or image data, and outputting the digital data and/or image data to a field programmable gate array chip through a sampling processor;

outputting initialization information through a microprocessor integrated in the field programmable gate array chip; outputting the initialization information through a display controller integrated in the field programmable gate array chip; transmitting the initialization information through the D-type connectors to the display modules to be tested; and performing initialization operations on the display modules to be tested;

reading stored digital data and/or image data required to perform light-on tests through a storage controller integrated in the field programmable gate array chip; and receiving micro control commands sent by the sampling processor, generating, according to the micro control commands, corresponding micro control parameters, and processing, according to the micro control parameters, required digital data and/or image data through the field programmable gate array chip; and outputting processed digital data and/or image data required to perform light-on tests on the display modules to be tested to the display modules to be tested through the display controller integrated in the field programmable gate array chip and connected to the D-type connectors, so that one-time inspections are performed on the display modules to be tested and operation of the light-on tests is simultaneously performed on the display modules to be tested.

In accordance with an embodiment of the present disclosure, only the integrated connector of the display light-on test device needs to be replaced for being adapted to a different mobile phone and performing a different light-on test.

In accordance with an embodiment of the present disclosure, when an initial code of a processor interface of the display panel is given through the storage controller integrated in the field programmable gate array chip, the display panel is lightened directly through the field programmable gate array chip, without providing power to the display panel by the application processor; or when an initial code of a processor interface of the display panel is not given, an image is first compressed into a standard VESC image receivable by a DIC of the display panel, and then the display panel is lightened through the application processor, a switch of the processor interface is then turned off, and the compressed image is sent through the field programmable gate array chip, and a final result is fed back to a display for display.

In accordance with an embodiment of the present disclosure, the method further includes: receiving mobile phone/user commands input by mobile phones/users, and outputting the mobile phone/user commands to the sampling processor.

In accordance with an embodiment of the present disclosure, receiving micro control commands transmitted by the sampling processor, generating, according to the micro control commands, corresponding micro control parameters, and processing, according to the micro control parameters, required digital data and/or image data through the field programmable gate array chip; and outputting processed digital data and/or image data required to perform light-on tests on the display modules to be tested to the display modules to be tested through the display controller integrated in the field programmable gate array chip and connected to the D-type connectors includes:

generating, according to the micro control commands, corresponding micro control parameters through a parameter configurator integrated in the field programmable gate array chip;

receiving digital data and/or image data output by the storage controller, and receiving micro control parameters sent by the parameter configurator, and processing, according to the micro control parameters, the digital data and/or image data through a digital/image processor integrated in the field programmable gate array chip; and operating under corresponding modes according to type mode selecting commands, performing selection processing on processed digital data and/or image data output by the digital/image processor, and outputting processed digital data and/or image data required to perform light-on tests on the display modules to be tested through a selection controller integrated in the field programmable gate array chip; and outputting, through the display controller, and transmitting, through the D-type connectors, selection processed digital data and/or image data to the corresponding display modules to be tested.

In accordance with an embodiment of the present disclosure, the selection controller receives type mode selecting commands output by the microprocessor, to operate, according to the type mode selecting commands, under corresponding modes.

The above solutions of the present disclosure have the following specific advantages: ① a display panel is connected to an application processor of a mobile phone through an integrated connector, to form a display module to be tested, wherein the integrated connector is configured with a test lead plug (male) and a test lead socket (female) correspondingly on a left side and a right side of the integrated connector, and the test lead plug and the test lead socket are both connected to a matching voltage switch, current switch, and standard current switch; ② with respect to a different type of mobile phone, only the integrated connector needs to be replaced for being adapted to the different type of mobile phone, to form display modules to be tested with different connector types; ③ a microprocessor, a display controller, and a storage controller are integrated into a field programmable gate array chip; a plurality of D-type connectors are correspondingly connected to matching display modules to be tested, so that one-time inspections are performed on different types of mobile phones, and operation of light-on tests is simultaneously performed on the different types of mobile phones, a hardware portion of the display light-on test device is simplified, a number of electronic devices used is reduced, breath of applications and stability of the display light-on test device are enhanced, costs are saved, and use and subsequent maintenance of the display light-on test device by a research and development personnel is facilitated.

DESCRIPTION OF DRAWINGS

In order to describe a technical solution in embodiments or existing technology more clearly, drawings required to be used by the embodiments or the existing technology are briefly introduced below. Obviously, the drawings in the description below are only some embodiments of the present disclosure. With respect to persons of ordinary skill in the art, under a premise that inventive efforts are not made, other drawings may be obtained based on these drawings.

DETAILED DESCRIPTION OF PREFERRED EMBODIMENTS

Figure 1:
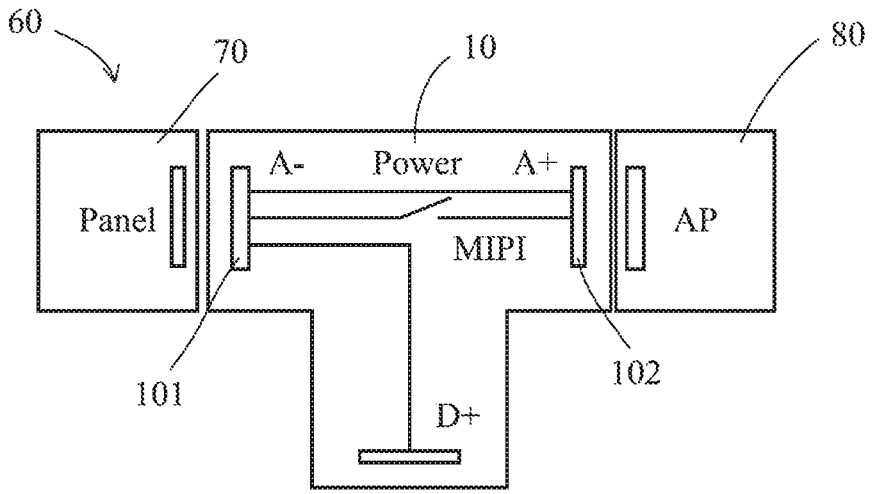
FIG. 1 is a schematic structural diagram of a display module to be tested of a display light-on test device in accordance with an embodiment of the present disclosure.

Refer to diagrams in the drawings. A same element is labeled by a same reference numeral. Description in conjunction with the drawings below is based on exemplified specific embodiments of the present disclosure. It is to be appreciated that the described specific embodiments herein are only used to illustrate the present disclosure, and should not be construed as limiting other specific embodiments of the present disclosure not described herein.

Figure 2:
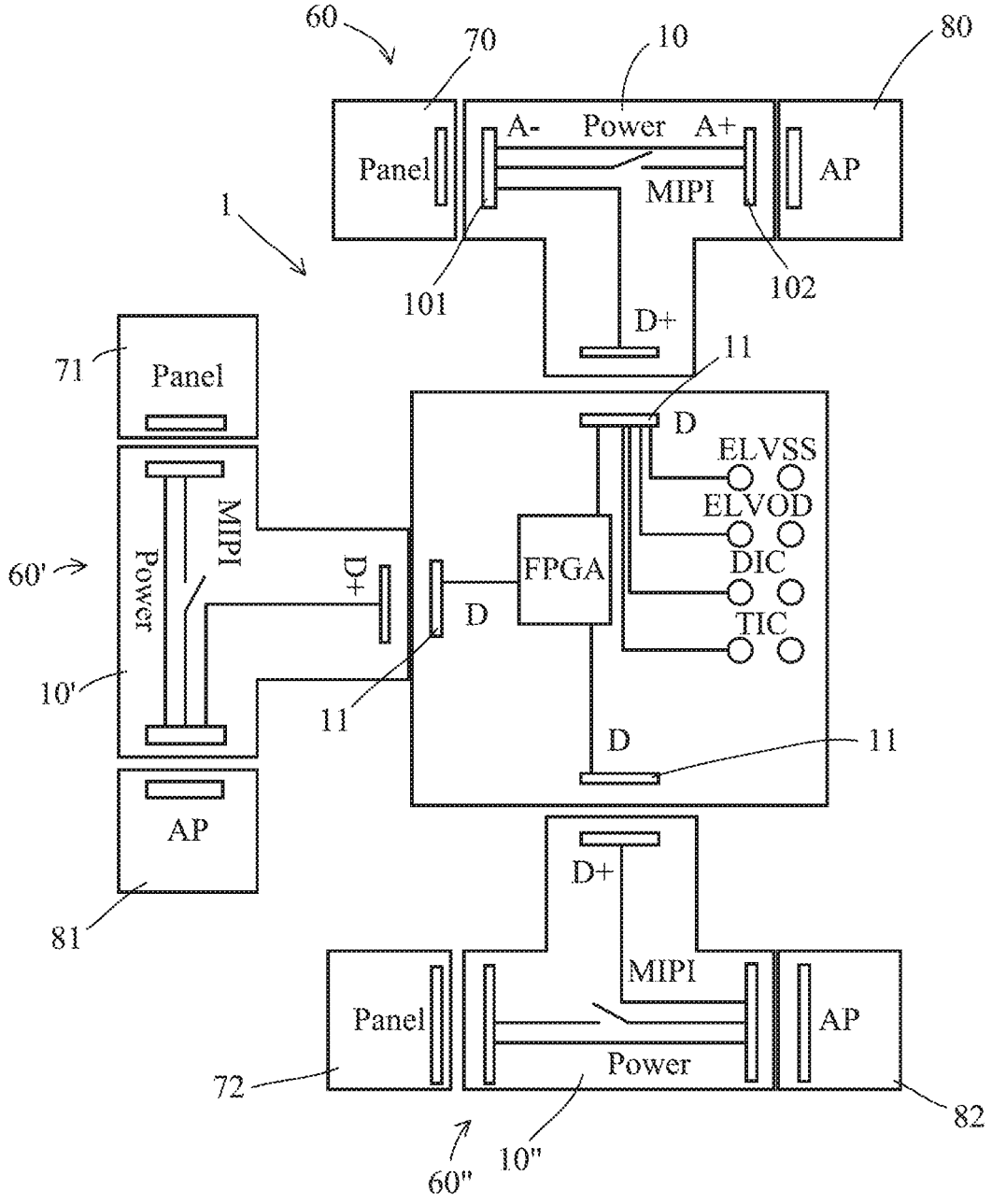
FIG. 2 is a schematic overall structural diagram of the display light-on test device in accordance with an embodiment of the present disclosure.
Figure 3:
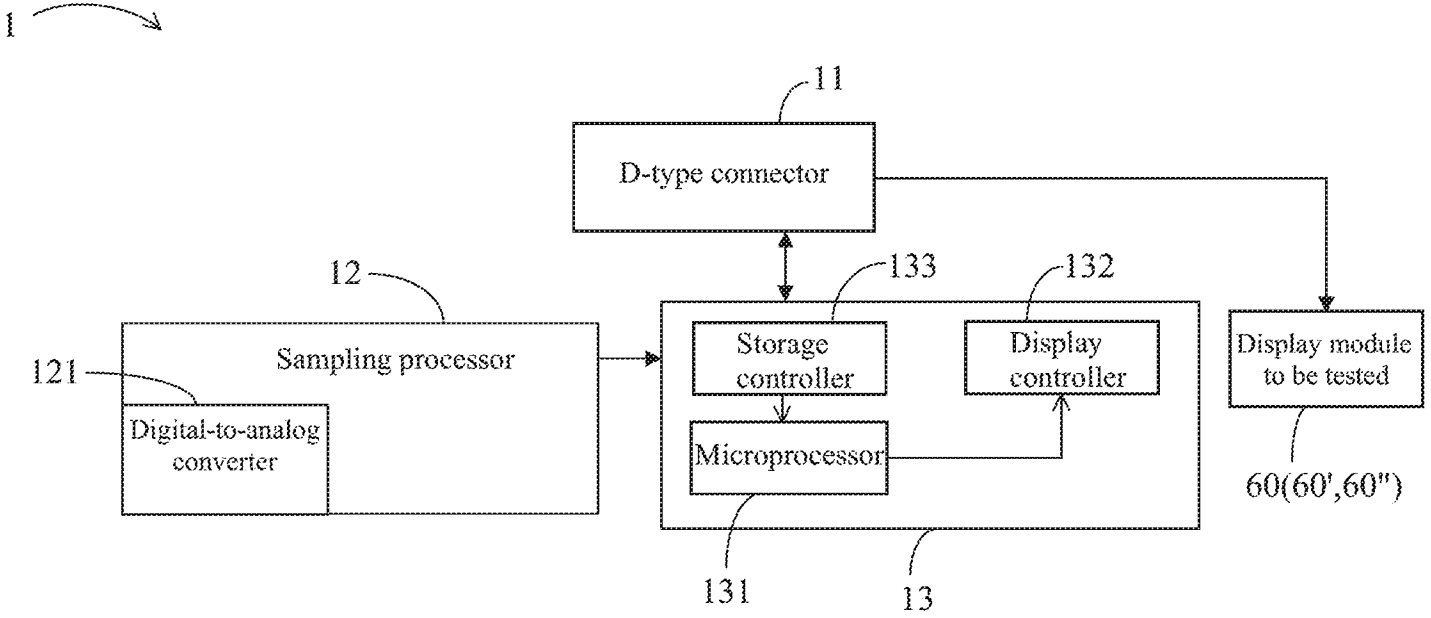
FIG. 3 is a schematic partial structural diagram of the display light-on test device in FIG. 2 in accordance with an embodiment of the present disclosure.

Referring to FIG. 1, FIG. 1 is a schematic structural diagram of a display module to be tested of a display light-on test device in accordance with an embodiment of the present disclosure. FIG. 2 is a schematic overall structural diagram of the display light-on test device in accordance with an embodiment of the present disclosure. FIG. 3 is a schematic partial structural diagram of the display light-on test device in FIG. 2 in accordance with an embodiment of the present disclosure.

In the present embodiment, the display light-on test device is configured to perform one-time inspections on a plurality of display modules to be tested, and perform operation of light-on tests simultaneously on the display modules to be tested. The display light-on test device 1 includes: an integrated connector 10, wherein the integrated connector 10 is configured with a row of test lead plugs (male) 101 and a row of test lead sockets (female) 102 correspondingly on a left side and a right side of the integrated connector 10, and each test lead plug 101 and each test lead socket 102 are both connected to a matching voltage switch, current switch, and standard current switch. Specifically, for example, each test lead plug 101 on the left side is installed with the corresponding voltage switch, current switch, and standard current switch. Each test lead socket 102 on the right side is installed with a corresponding inline voltage meter, inline current meter, and current regulator. Therefore, a display panel 70 on the left side is connected to an application processor 80 of a mobile phone on the right side, to form a display module to be tested 60.

When a different type of mobile phone has a different kind of connector, refer to FIG. 2. Only the integrated connector 10' (10") needs to be replaced for the display light-on test device 1 to be adapted to the different type of mobile phone. Therefore, a display panel 71 (72) on the left side is connected to an application processor 81 (82) of a mobile phone on the right side, to form another display module to be tested 60' (60"), so that a light-on test may be performed.

Referring to FIGS. 2 and 3, in the present embodiment, the display light-on test device 1 further includes: a plurality of D-type connectors 11, a sampling processor 12, and a field programmable gate array chip 13. The field programmable gate array chip 13 is connected to the D-type connectors 11 and the sampling processor 12. The field programmable gate array chip 13 includes: a microprocessor 131, a display controller 132, and a storage controller 133 storing computing programs.

Specifically, the D-type connectors 11 are configured to be correspondingly connected to matching display modules to be tested 60' (60") among mobile phones with different connector types. Therefore, a number of the D-type connectors 11 is determined by a plurality of mobile phones connected. Referring to FIG. 2, in the present embodiment, 3 simultaneously connected mobile phones with different connector types are illustrated as an example. The 3 D-type connectors 11 are all correspondingly connected to the matching display modules to be tested 60, 60', 60". The D-type connectors 11 receive and transmit a processor interface power signal, a positive voltage power signal, a negative voltage power signal, a TIC power signal, etc. The sampling processor 12 is configured to receive mobile phone (or user) commands and output, according to the mobile phone (or user) commands, corresponding micro control commands, sample and quantize a received DIC power signal, TIC power signal, positive voltage power signal, negative voltage power signal, etc., into required signal data (including digital data and/or image data), and output the signal data to the field programmable gate array chip 13. The field programmable gate array chip 13 is connected to the D-type connectors and the sampling processor 12 to receive the signal data and generate, according to the micro control commands, corresponding micro control parameters, and process the signal data according to the micro control parameters, to output signal data required to perform the light-on tests to the display modules to be tested 60, 60', 60", so that the light-on tests are performed on the display modules to be tested 60, 60', 60".

Specifically, the field programmable gate array chip 13 has the microprocessor 131, the display controller 132, and the storage controller 133 storing computing programs integrated therein. The microprocessor 131 is connected to the display controller 132, and the display controller 132 is connected to the display modules to be tested 60, 60', 60" through the D-type connectors 11. The storage controller 133 is connected to the D-type connectors 11 and the sampling processor, and reads digital signal data and/or image signal data stored internally, and then provides the digital signal data and/or image signal data suitably to the microprocessor 131.

Specifically, the microprocessor 131 integrated within the field programmable gate array chip 13 is configured to output initialization information. The display controller 132 is configured to output the initialization information to each display module to be tested 60 (60', 60") for an initialization operation to be performed on each display module to be tested 60 (60', 60"). The field programmable gate array chip 13 is integrated with the storage controller 133 internally configured with the stored computing programs, and connected to the D-type connectors 11 and the sampling processor 12 to receive and store digital data and/or image data required to perform the light-on tests and the micro control commands sent by the D-type connectors 11, and the sampling processor 12, and read and perform analysis and categorization on internally stored digital data and/or image data. The field programmable gate array chip 13 generates, according to the micro control commands, the corresponding micro control parameters, processes, according to the micro control parameters, digital data and/or image data, to output processed digital data and/or image data required to perform light-on tests on the display modules to be tested. The processed digital data and/or image data is suitably provided to the microprocessor 131, and transmitted to the display modules to be tested 60, 60', 60" through the display controller 132 connected to the D-type connectors 11, so that the one-time inspections are performed on the display modules to be tested 60, 60', 60", and the operation of the light-on tests is simultaneously performed on the display modules to be tested 60, 60', 60".

Specifically, the sampling processor 12 further includes: a digital-to-analog converter 121 configured to sample and quantize voltage and current signals, and power consumption received by the sampling processor 12 into required digital signals, and output the digital signals to the field programmable gate array chip 13, so that the field programmable gate array chip 13 performs the light-on tests, thereby realizing automatic test operation.

In the present embodiment, a display panel is connected to an application processor of a mobile phone through an integrated connector, to form a display module to be tested; with respect to a different type of mobile phone, only the integrated connector needs to be replaced for being adapted to the different type of mobile phone, to form display modules to be tested with different connector types; a microprocessor, a display controller, and a storage controller are integrated into a field programmable gate array chip; and a plurality of D-type connectors are correspondingly connected to matching display modules to be tested, so that one-time inspections are performed on different types of mobile phones, and operation of light-on tests is simultaneously performed on the different types of mobile phones, a hardware portion of the display light-on test device is simplified, a number of electronic devices used is reduced, breath of applications and stability of the display light-on test device are enhanced, costs are saved, and use and subsequent maintenance of the display light-on test device by a research and development personnel is facilitated.

When an initial code of a DIC processor interface of a display panel is given through the storage controller integrated in the field programmable gate array chip, the display panel is lightened directly through the field programmable gate array chip, without providing power to the display panel by the application processor, but providing power to the display panel by the field programmable gate array chip; or when an initial code of a DIC processor interface of a display panel is not given, an image is first compressed into a standard VESC image receivable by a DIC, and then the display panel is lightened through the application processor, a switch of the processor interface is then turned off, and the compressed image is sent through the field programmable gate array chip, and a final result is fed back to a display for display. The field programmable gate array chip can further be combined with an optical algorithm, to analyze optical issues.

Figure 4:
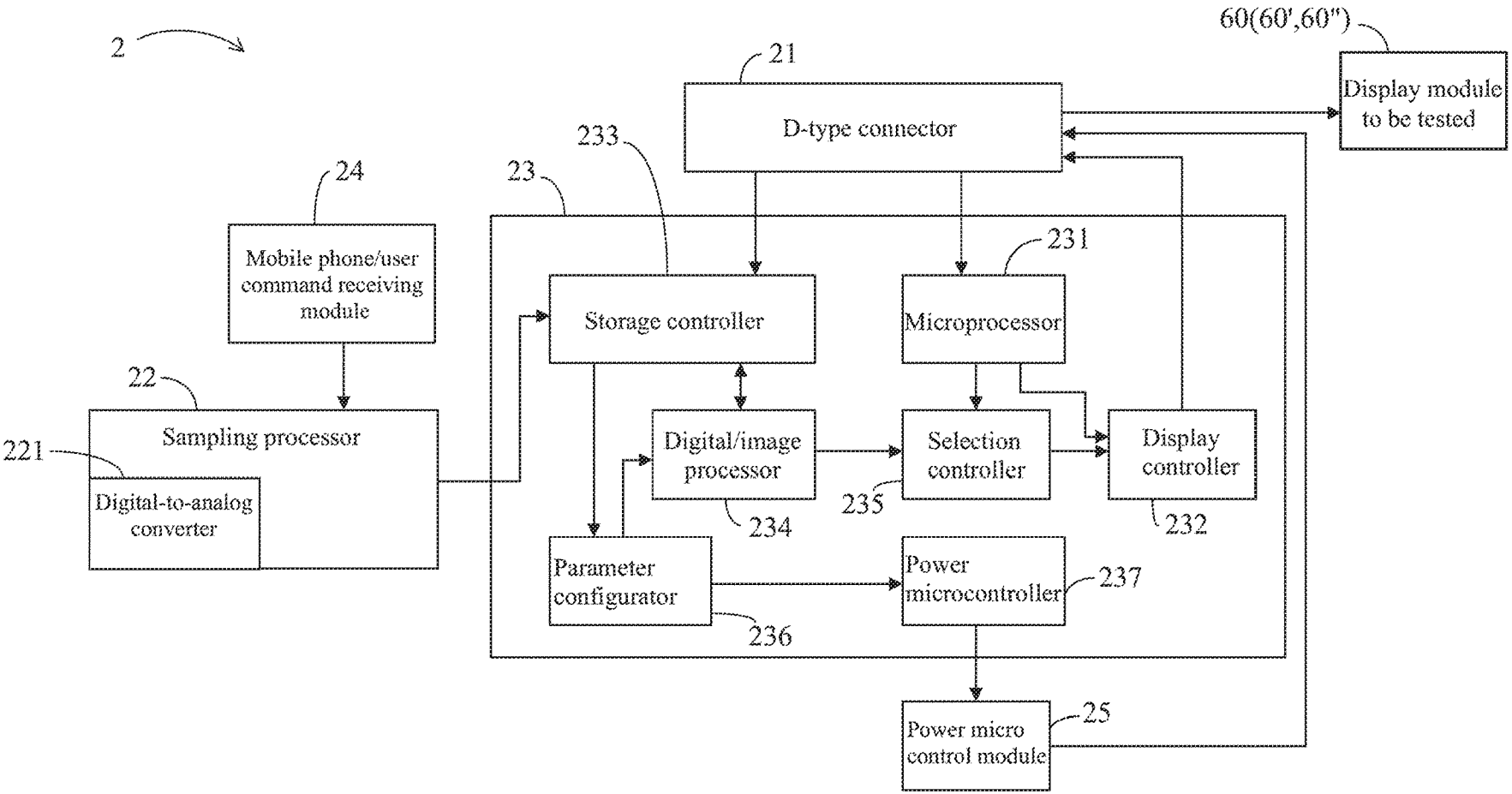
FIG. 4 is a schematic partial structural diagram of the display light-on test device in accordance with another embodiment of the present disclosure.

Referring to FIGS. 2 and 4, FIG. 4 is a schematic partial structural diagram of the display light-on test device in accordance with another embodiment of the present disclosure. Compared to the above embodiment, the display light-on test device 2 in the present embodiment includes: an integrated connector 10, D-type connectors 21, a sampling processor 22, a field programmable gate array chip 23, a mobile phone/user command receiving module 24, and a power micro control module 25. The field programmable gate array chip 23 is connected to the D-type connectors 21 and the sampling processor 22. The field programmable gate array chip 23 includes a microprocessor 231, a display controller 232, a storage controller 233, a digital/image processor 234, a selection controller 235, a parameter configurator 236, and a power microcontroller 237.

Specifically, the sampling processor 22 further includes: a digital-to-analog converter 221 configured to sample and quantize voltage and current signals, and power consumption received by the sampling processor 22 into required digital signals, and output the digital signals to the field programmable gate array chip 23, so that the field programmable gate array chip 23 performs the light-on tests, thereby realizing automatic test operation.

Specifically, the microprocessor 231 is connected to the display controller 232, and the display controller 232 is connected to the display modules to be tested 60, 60', 60" through the D-type connectors 21. The storage controller 233 stores computing programs therein, and is connected to the D-type connectors 21 and the sampling processor 22. The storage controller 233 reads digital signal data and/or image signal data stored internally, and then provides the digital signal data and/or image signal data suitably to the microprocessor 131. The microprocessor 231 is further connected to the selection controller 235. The mobile phone/user command receiving module 24 is connected to the sampling processor 22.

The storage controller 233 is further connected to the digital/image processor 234 and the parameter configurator 236. The digital/image processor 234 is further connected to the selection controller 235 and the parameter configurator 236. The selection controller 235 is further connected to the display controller 232.

The parameter configurator 236 is further connected to the power microcontroller 237. The power microcontroller 237 is connected to the power micro control module 25.

Specifically, the storage controller 233 is connected to the D-type connectors 21 and the sampling processor 22 to receive and store digital data and/or image data required to perform the light-on tests and micro control commands sent by the D-type connectors 21, and the sampling processor 22, and read and perform analysis and categorization on internally stored digital data and/or image data. The parameter configurator 236 receives micro control commands output by the storage controller 233, and generates, according to the micro control commands, corresponding micro control parameters. The digital/image processor 234 is configured to receive digital data and/or image data output by the storage controller 233, and the digital/image processor 234 is further configured to process, according to control parameters output by the parameter configurator 236, the digital data and/or image data. The selection controller 235 is configured to receive type mode selecting commands output by the microprocessor 231 (i.e. display modules to be tested with different connector types received by the D-type connectors 21), operate under corresponding modes according to the type mode selecting commands, perform selection processing on processed digital data and/or image data output by the digital/image processor, and output processed digital data and/or image data required to perform the light-on tests on the display modules to be tested. The selection controller 235 transmits, through the display controller 132 connected to the D-type connectors 11, matching digital data and/or image data to display modules to be tested 60, 60', 60", so that one-time inspections are performed on the display modules to be tested 60, 60', 60", and operation of the light-on tests is simultaneously performed on the display modules to be tested 60, 60', 60".

Specifically, the sampling processor 22 is configured to receive mode commands output by the mobile phone/user command receiving module 24, analyze the mode commands to generate the micro control commands, and send control commands obtained from analysis to the parameter configurator 236 throughout storage controller 233. The parameter configurator 236 generates the corresponding control parameters. The digital/image processor 234 is further configured to process, according to the control parameters output by the parameter configurator 236, the digital data and/or image data. The selection controller 235 is configured to output, according to type mode selecting commands output by the microprocessor 231, corresponding parameters for selecting corresponding processed digital data and/or image data to the digital/image processor 234, and corresponding power control parameters to the power microcontroller 237. The power microcontroller 237 receives the power control parameters output by the selection controller 235, and generates, according to the power control parameters, corresponding power control commands, and outputs the corresponding power control commands to the power micro control module 25, which controls corresponding power voltage to be output by the power micro control module 25.

The power micro control module 25 is configured to receive power control parameters output by the field programmable gate array chip 23, and output through each of the D-type connectors, the corresponding power voltage to each of the display modules to be tested 60, 60', 60", to control the light-on tests to be performed on the display modules to be tested 60, 60', 60" at different power.

In the present embodiment, a display is connected to an application processor of a mobile phone through an integrated connector, to form a display module to be tested; with respect to a different type of mobile phone, only the integrated connector needs to be replaced for being adapted to the different type of mobile phone, to form display modules to be tested with different connector types; a microprocessor, a display controller, and a storage controller are integrated into a field programmable gate array chip; and a plurality of D-type connectors are correspondingly connected to matching display modules to be tested, so that one-time inspections are performed on different types of mobile phones, and operation of light-on tests is simultaneously performed on the different types of mobile phones, a hardware portion of the display light-on test device is simplified, a number of electronic devices used is reduced, breath of applications and stability of the display light-on test device are enhanced, costs are saved, and use and subsequent maintenance of the display light-on test device by a research and development personnel is facilitated.

When an initial code of a DIC processor interface of a display panel is given through the storage controller integrated in the field programmable gate array chip, the display panel is lightened directly through the field programmable gate array chip, without providing power to the display panel by the application processor, but providing power to the display panel by the field programmable gate array chip; or when an initial code of a DIC processor interface of a display panel is not given, an image is first compressed into a standard VESC image receivable by a DIC, and then the display panel is lightened through the application processor, a switch of the processor interface is then turned off, and the compressed image is sent through the field programmable gate array chip, and a final result is fed back to a display for display. The field programmable gate array chip can further be combined with an optical algorithm, to analyze optical issues.

Figure 5:
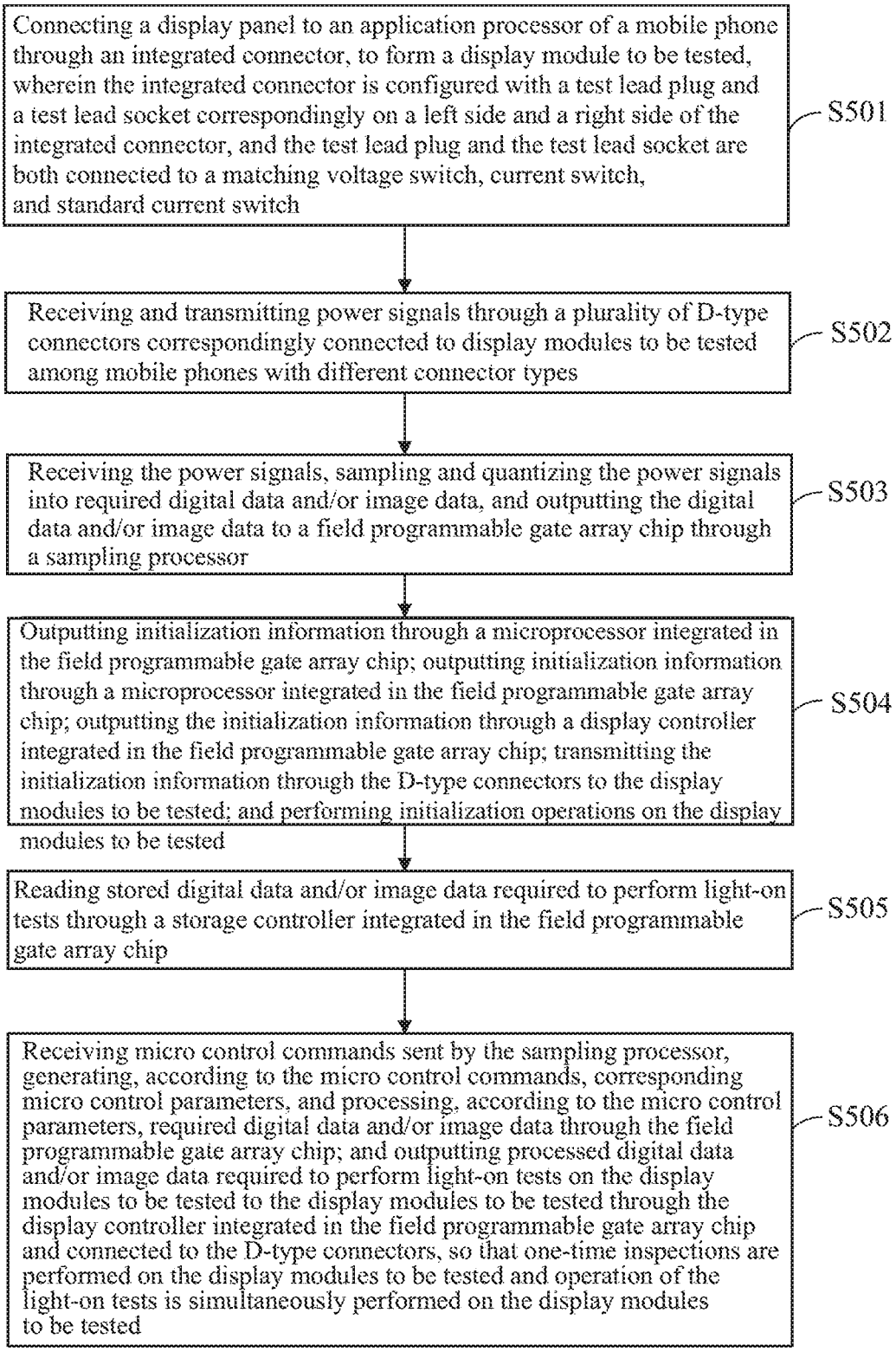
FIG. 5 is a flowchart of a display light-on test method in accordance with an embodiment of the present disclosure.

Referring to FIG. 5, FIG. 5 is a flowchart of a display light-on test method in accordance with an embodiment of the present disclosure. The display light-on test method of the present disclosure uses any of the above display light-on test devices. As illustrated in FIG. 5, the method includes:

S501: connecting a display panel to an application processor of a mobile phone through an integrated connector, to form a display module to be tested, wherein the integrated connector is configured with a test lead plug and a test lead socket correspondingly on a left side and a right side of the integrated connector, and the test lead plug and the test lead socket are both connected to a matching voltage switch, current switch, and standard current switch;

S502: receiving and transmitting power signals through a plurality of D-type connectors correspondingly connected to display modules to be tested among mobile phones with different connector types;

S503: receiving the power signals, sampling and quantizing the power signals into required digital data and/or image data, and outputting the digital data and/or image data to a field programmable gate array chip through a sampling processor;

S504: outputting initialization information through a microprocessor integrated in the field programmable gate array chip; outputting initialization information through a microprocessor integrated in the field programmable gate array chip; outputting the initialization information through a display controller integrated in the field programmable gate array chip; transmitting the initialization information through the D-type connectors to the display modules to be tested; and performing initialization operations on the display modules to be tested;

S505: reading stored digital data and/or image data required to perform light-on tests through a storage controller integrated in the field programmable gate array chip;

S506: receiving micro control commands sent by the sampling processor, generating, according to the micro control commands, corresponding micro control parameters, and processing, according to the micro control parameters, required digital data and/or image data through the field programmable gate array chip; and outputting processed digital data and/or image data required to perform light-on tests on the display modules to be tested to the display modules to be tested through the display controller integrated in the field programmable gate array chip and connected to the D-type connectors, so that one-time inspections are performed on the display modules to be tested and operation of the light-on tests is simultaneously performed on the display modules to be tested.

A detailed test process has been provided in the embodiments above and is omitted here.

In the present embodiment, a display is connected to an application processor of a mobile phone through an integrated connector, to form a display module to be tested; with respect to a different type of mobile phone, only the integrated connector needs to be replaced for being adapted to the different type of mobile phone, to form display modules to be tested with different connector types; a microprocessor, a display controller, and a storage controller are integrated into a field programmable gate array chip; and a plurality of D-type connectors are correspondingly connected to matching display modules to be tested, so that one-time inspections are performed on different types of mobile phones, and operation of light-on tests is simultaneously performed on the different types of mobile phones, a hardware portion of the display light-on test device is simplified, a number of electronic devices used is reduced, breath of applications and stability of the display light-on test device are enhanced, costs are saved, and use and subsequent maintenance of the display light-on test device by a research and development personnel is facilitated.

When an initial code of a DIC processor interface of a display panel is given through the storage controller integrated in the field programmable gate array chip, the display panel is lightened directly through the field programmable gate array chip, without providing power to the display panel by the application processor, but providing power to the display panel by the field programmable gate array chip; or when an initial code of a DIC processor interface of a display panel is not given, an image is first compressed into a standard VESC image receivable by a DIC, and then the display panel is lightened through the application processor, a switch of the processor interface is then turned off, and the compressed image is sent through the field programmable gate array chip, and a final result is fed back to a display for display. The field programmable gate array chip can further be combined with an optical algorithm, to analyze optical issues.

In summary, although the present disclosure has been described with preferred embodiments thereof above, it is not intended to be limited by the foregoing preferred embodiments. Persons skilled in the art can carry out many changes and modifications to the described embodiments without departing from the scope and the spirit of the present disclosure. An equivalent structure or an equivalent process obtained using the content of the specification and the drawings of the present disclosure, or an embodiment obtained by directly or indirectly applying the content of the specification and the drawings of the present disclosure to another related technical field should be equally included in the patent protection scope of the present disclosure.

What is claimed is:

1. A display light-on test device, configured to perform light-on tests on a plurality of display modules to be tested simultaneously, and comprising:

a plurality of integrated connectors, wherein each of the integrated connectors is configured with a corresponding test lead plug and a corresponding test lead socket on both sides of each of the integrated connectors; and the corresponding test lead plug and the corresponding test lead socket are both connected to a matching voltage switch, current switch, and standard current switch, so that the integrated connectors connect display panels of a corresponding plurality of mobile phones with different connector types to application processors thereof, to form the display modules to be tested;

a plurality of D-type connectors correspondingly connected to the display modules to be tested, and configured to receive and transmit power signals;

a sampling processor configured to receive the power signals, sample and quantize the power signals into required digital data and/or image data, and output the digital data and/or image data to a field programmable gate array chip, receive commands, and output, according to the commands, corresponding micro control commands; and the field programmable gate array chip having a microprocessor, a display controller, and a storage controller integrated therein, wherein the microprocessor is configured to output initialization information, and is connected to the display controller; the field programmable gate array chip outputs, through the display controller, the initialization information which is transmitted to the display modules to be tested through the D-type connectors, for initialization operations to be performed; the storage controller is connected to the D-type connectors and the sampling processor, and configured to receive the digital data and/or image data and the micro control commands; the field programmable gate array chip generates, according to the micro control commands, corresponding micro control parameters, and processes, according to the micro control parameters, the digital data and/or image data, to output digital data and/or image data required to perform the light-on tests on the display modules to be tested to the display modules to be tested, so that operation of the light-on tests is performed on the display modules to be tested simultaneously.

2. The display light-on test device of claim 1, wherein the sampling processor comprises:

a digital-to-analog converter configured to sample and quantize voltage and current signals, and power consumption received by the sampling processor into required digital signals, and output the digital signals to the field programmable gate array chip, so that the field programmable gate array chip performs the light-on tests.

3. The display light-on test device of claim 1, wherein the sampling processor is further connected to a mobile phone/user command receiving module configured to receive mobile phone/user commands input by mobile phones/users, and output the mobile phone/user commands to the sampling processor.

4. The display light-on test device of claim 1, wherein the field programmable gate array chip further comprises:

a parameter configurator connected to the storage controller, and configured to generate, according to the micro control commands, the corresponding micro control parameters;

a digital/image processor connected to the storage controller and the parameter configurator, and configured to receive digital data and/or image data output by the storage controller, and receive micro control parameters sent by the parameter configurator, and process, according to the micro control parameters, the digital data and/or image data; and a selection controller connected to the digital/image processor, and configured to operate under corresponding modes according to type mode selecting commands, perform selection processing on processed digital data and/or image data output by the digital/image processor, and output processed digital data and/or image data required to perform light-on tests on the display modules to be tested; and the selection controller is further connected to the display controller, so that selection processed digital data and/or image data is output through the display controller and transmitted through the D-type connectors to the corresponding display modules to be tested.

5. The display light-on test device of claim 4, wherein the selection controller is further connected to the microprocessor, and is further configured to receive type mode selecting commands output by the microprocessor, to operate, according to the type mode selecting commands, under corresponding modes.

6. The display light-on test device of claim 5, wherein the display light-on test device further comprises:

a power micro control module connected between the field programmable gate array chip and each of the D-type connectors, and configured to receive power control parameters output by the field programmable gate array chip, and output, through each of the D-type connectors, a corresponding power voltage to each of the display modules to be tested according to the power control parameters, to control the light-on tests to be performed on the display modules to be tested at different power.

7. The display light-on test device of claim 6, wherein the field programmable gate array chip further comprises:

a power microcontroller connected to the parameter configurator and the power micro control module, wherein the control parameters generated by the parameter configurator comprise the power control parameters; the power microcontroller is configured to receive the power control parameters, generate, according to the power control parameters, corresponding power control commands, and output the corresponding power control commands to the power micro control module, which controls the corresponding power voltage to be output.

8. A display light-on test device, configured to perform light-on tests on a plurality of display modules to be tested simultaneously, and comprising:

an integrated connector, wherein the integrated connector is configured with a test lead plug and a test lead socket on both sides of the integrated connector; and the test lead plug and the test lead socket are both connected to a matching voltage switch, current switch, and standard current switch, so that the integrated connector connects a display panel to an application processor, to form a display module to be tested;

a plurality of D-type connectors correspondingly connected to the display modules to be tested, and configured to receive and transmit power signals;

a sampling processor configured to receive the power signals, sample and quantize the power signals into required digital data and/or image data, and output the digital data and/or image data to a field programmable gate array chip, receive commands, and output, according to the commands, corresponding micro control commands; and the field programmable gate array chip having a microprocessor, a display controller, and a storage controller integrated therein, wherein the microprocessor is configured to output initialization information, and is connected to the display controller; the field programmable gate array chip outputs, through the display controller, the initialization information which is transmitted to the display modules to be tested through the D-type connectors, for initialization operations to be performed; the storage controller is connected to the D-type connectors and the sampling processor, and configured to receive the digital data and/or image data and the micro control commands; the field programmable gate array chip generates, according to the micro control commands, corresponding micro control parameters, and processes, according to the micro control parameters, the digital data and/or image data, to output digital data and/or image data required to perform the light-on tests on the display modules to be tested to the display modules to be tested, so that operation of the light-on tests is performed on the display modules to be tested simultaneously.

9. The display light-on test device of claim 8, wherein the sampling processor comprises:

a digital-to-analog converter configured to sample and quantize voltage and current signals, and power consumption received by the sampling processor into required digital signals, and output the digital signals to the field programmable gate array chip, so that the field programmable gate array chip performs the light-on tests.

10. The display light-on test device of claim 8, wherein the sampling processor is further connected to a mobile phone/user command receiving module configured to receive mobile phone/user commands input by mobile phones/users, and output the mobile phone/user commands to the sampling processor.

11. The display light-on test device of claim 8, wherein the field programmable gate array chip further comprises:

a parameter configurator connected to the storage controller, and configured to generate, according to the micro control commands, the corresponding micro control parameters;

a digital/image processor connected to the storage controller and the parameter configurator, and configured to receive digital data and/or image data output by the storage controller, and receive micro control parameters sent by the parameter configurator, and process, according to the micro control parameters, the digital data and/or image data; and a selection controller connected to the digital/image processor, and configured to operate under corresponding modes according to type mode selecting commands, perform selection processing on processed digital data and/or image data output by the digital/image processor, and output processed digital data and/or image data required to perform the light-on tests on the display modules to be tested; and the selection controller is further connected to the display controller, so that selection processed digital data and/or image data is output through the display controller and transmitted through the D-type connectors to the corresponding display modules to be tested.

12. The display light-on test device of claim 11, wherein the selection controller is further connected to the microprocessor, and is further configured to receive type mode selecting commands output by the microprocessor, to operate, according to the type mode selecting commands, under the corresponding modes.

13. The display light-on test device of claim 12, wherein the display light-on test device further comprises:

a power micro control module connected between the field programmable gate array chip and each of the D-type connectors, and configured to receive power control parameters output by the field programmable gate array chip, and output, through each of the D-type connectors, a corresponding power voltage to each of the display modules to be tested according to the power control parameters, to control the light-on tests to be performed on the display modules to be tested at different power.

14. The display light-on test device of claim 13, wherein the field programmable gate array chip further comprises:

a power microcontroller connected to the parameter configurator and the power micro control module, wherein the control parameters generated by the parameter configurator comprise the power control parameters; the power microcontroller is configured to receive the power control parameters, generate, according to the power control parameters, corresponding power control commands, and output the corresponding power control commands to the power micro control module, which controls the corresponding power voltage to be output.

15. A display light-on test method that uses a display light-on test device of claim 8, comprising:

connecting a display panel to an application processor through an integrated connector, to form a display module to be tested, wherein the integrated connector is configured with a test lead plug and a test lead socket on both sides of the integrated connector; and the test lead plug and the test lead socket are both connected to a matching voltage switch, current switch, and standard current switch;

receiving and transmitting power signals through a plurality of D-type connectors correspondingly connected to display modules to be tested;

receiving the power signals, sampling and quantizing the power signals into required digital data and/or image data, and outputting the digital data and/or image data to a field programmable gate array chip through a sampling processor;

outputting initialization information through a microprocessor integrated in the field programmable gate array chip; outputting the initialization information through a display controller integrated in the field programmable gate array chip; transmitting the initialization information through the D-type connectors to the display modules to be tested; and performing initialization operations on the display modules to be tested;

reading stored digital data and/or image data required to perform light-on tests through a storage controller integrated in the field programmable gate array chip; and receiving micro control commands sent by the sampling processor, generating, according to the micro control commands, corresponding micro control parameters, and processing, according to the micro control parameters, required digital data and/or image data through the field programmable gate array chip; and outputting processed digital data and/or image data required to perform light-on tests on the display modules to be tested to the display modules to be tested through the display controller integrated in the field programmable gate array chip and connected to the D-type connectors, so that one-time inspections are performed on the display modules to be tested and operation of the light-on tests is simultaneously performed on the display modules to be tested.

16. The display light-on test method of claim 15, wherein only the integrated connector of the display light-on test device needs to be replaced for being adapted to a different mobile phone and performing a different light-on test.

17. The display light-on test method of claim 15, wherein when an initial code of a processor interface of the display panel is given through the storage controller integrated in the field programmable gate array chip, the display panel is lightened directly through the field programmable gate array chip, without providing power to the display panel by the application processor; or when an initial code of a processor interface of the display panel is not given, an image is first compressed into a standard VESC image receivable by a DIC of the display panel, and then the display panel is lightened through the application processor, a switch of the processor interface is then turned off, and the compressed image is sent through the field programmable gate array chip, and a final result is fed back to a display for display.

18. The display light-on test method of claim 15, further comprising:

receiving mobile phone/user commands input by mobile phones/users, and outputting the mobile phone/user commands to the sampling processor.

19. The display light-on test method of claim 15, wherein receiving micro control commands transmitted by the sampling processor, generating, according to the micro control commands, corresponding micro control parameters, and processing, according to the micro control parameters, required digital data and/or image data through the field programmable gate array chip; and outputting processed digital data and/or image data required to perform light-on tests on the display modules to be tested to the display modules to be tested through the display controller integrated in the field programmable gate array chip and connected to the D-type connectors comprises:

generating, according to the micro control commands, corresponding micro control parameters through a parameter configurator integrated in the field programmable gate array chip;

receiving digital data and/or image data output by the storage controller, and receiving micro control parameters sent by the parameter configurator, and processing, according to the micro control parameters, the digital data and/or image data through a digital/image processor integrated in the field programmable gate array chip; and operating under corresponding modes according to type mode selecting commands, performing selection processing on processed digital data and/or image data output by the digital/image processor, and outputting processed digital data and/or image data required to perform light-on tests on the display modules to be tested through a selection controller integrated in the field programmable gate array chip; and outputting, through the display controller, and transmitting, through the D-type connectors, selection processed digital data and/or image data to the corresponding display modules to be tested.

20. The display light-on test method of claim 19, wherein the selection controller receives type mode selecting commands output by the microprocessor, to operate, according to the type mode selecting commands, under corresponding modes.

* * * * *